United States Patent [19]

Zimmerman

[11] Patent Number: 4,848,011

[45] Date of Patent: Jul. 18, 1989

[54] LOADER BUCKET

[76] Inventor: Harold M. Zimmerman, Rte. 1, Wabash Rd., Ephrata, Pa. 17522

[21] Appl. No.: 77,810

[22] Filed: Jul. 27, 1987

[51] Int. Cl.[4] ..... E02F 3/76

[52] U.S. Cl. ..... 37/117.5; 414/912; 37/DIG. 3

[58] Field of Search ..... 37/117.5, DIG. 3, DIG. 12, 37/103; 172/777, 782; 414/722, 723, 724, 726, DIG. 912

[56] References Cited

U.S. PATENT DOCUMENTS

| | | | |
|---|---|---|---|
| 1,706,257 | 3/1929 | Ronning | 37/DIG. 3 X |
| 3,403,802 | 10/1968 | Lundell | 37/117.5 X |
| 3,704,754 | 12/1972 | Layton | 37/117.5 X |
| 3,776,318 | 12/1973 | Layton | 37/DIG. 3 X |
| 3,822,756 | 7/1974 | Martin | 37/DIG. 3 X |
| 3,866,342 | 2/1975 | Cooper | 37/117.5 |
| 4,088,236 | 5/1978 | Moore | 37/117.5 X |
| 4,189,854 | 2/1980 | Haynes | 37/117.5 |
| 4,204,348 | 5/1980 | Lydie | 37/117.5 |
| 4,222,186 | 9/1980 | Molby | 37/117.5 X |
| 4,255,884 | 3/1981 | Williams | 37/117.5 |
| 4,360,980 | 11/1982 | Jarvis | 37/117.5 |
| 4,439,938 | 4/1984 | Grant | 37/117.5 |
| 4,463,507 | 8/1984 | Gaub | 37/117.5 |
| 4,464,852 | 8/1984 | Rice | 37/117.5 |
| 4,550,512 | 11/1985 | Felster | 37/117.5 |

FOREIGN PATENT DOCUMENTS 852925 11/1960 United Kingdom .

*Primary Examiner*—E. H. Eickholt

[57] ABSTRACT

A loader bucket is disclosed wherein the rear wall portion of the loader bucket is provided with a mounting portion includng opposing fore-and-aft extending mounting flanges having connection means associated therewith to permit the attachment of the loader bucket to the back of a narrower backhoe bucket to permit the backhoe to be utilized as a loader. The mounting portion is preferably recessed into the bucket cavity and is provided with a configuration corresponding to the curved backing wall of the backhoe bucket to permit a snug mounting therebetween.

7 Claims, 5 Drawing Sheets

Fig. 5
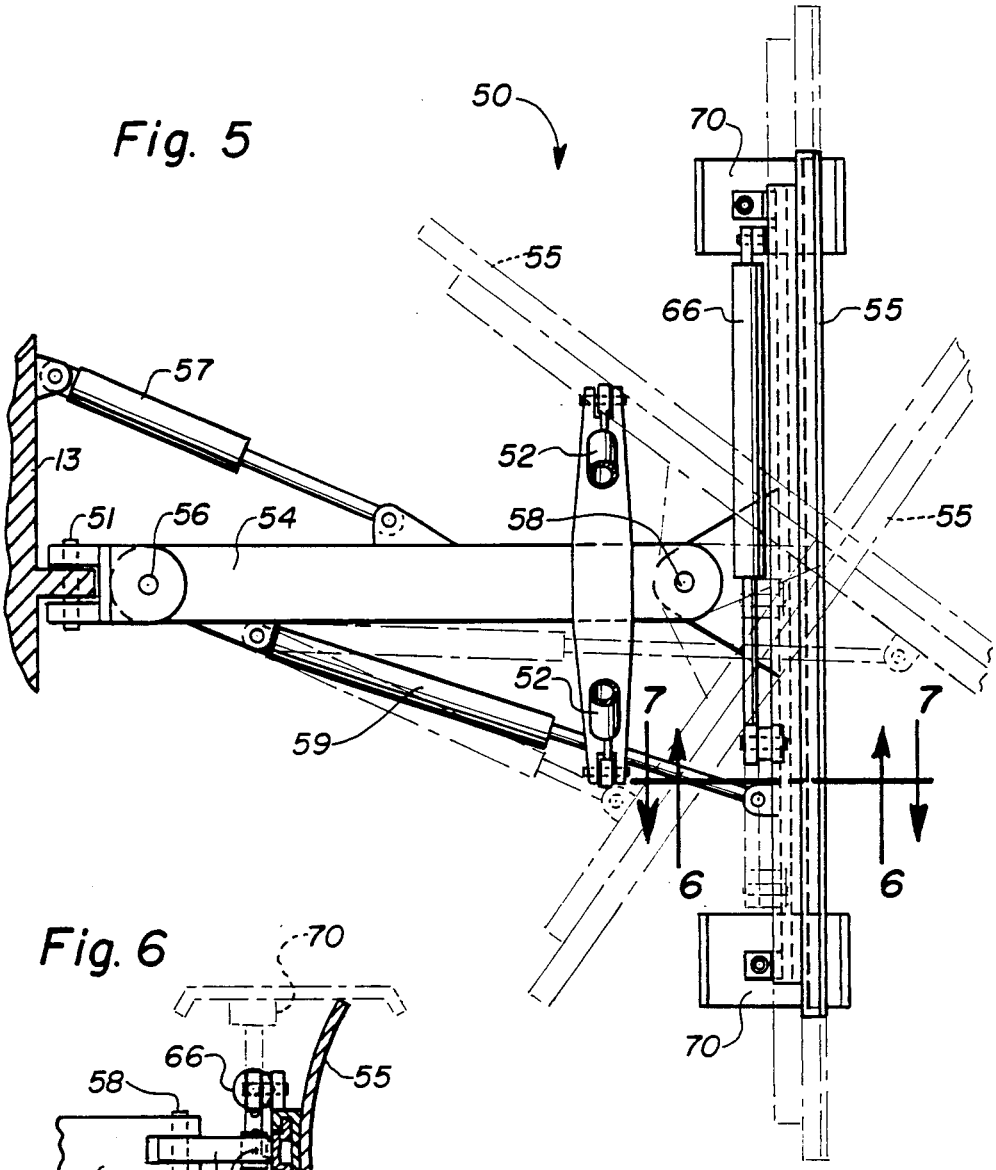
Fig. 6
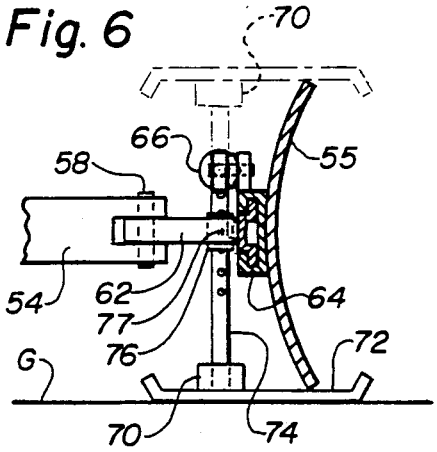
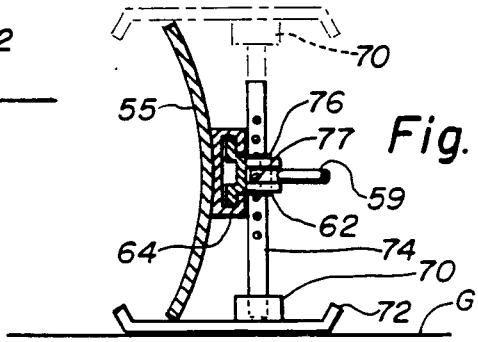
Fig. 7

LOADER BUCKET

BACKGROUND OF THE INVENTION

The present invention relates generally to earthworking machines and, more particularly, to an improved loader bucket to permit the attachment thereto to a narrower backhoe bucket.

A number of prior art devices have provided for the mounting of one earthworking tool, such as a dozer blade, to the structure of another earthworking tool, such as a loader bucket. One such device is shown, for example, in U.S. Pat. No. 4,463,507. These devices are cumbersome and structurally complex, typically requiring a significant amount of time to install. Nevertheless, none of the known prior art devices provide for an easy and convenient attachment of a loader bucket to the back side of a backhoe bucket to permit the backhoe assembly to be utilized as a front end loader.

SUMMARY OF THE INVENTION

It is an object of this invention to overcome the aforementioned disadvantages of the prior art by providing a loader bucket adapted to be attached to the back side of a backhoe bucket to enable the backhoe assembly to be utilized as a front end loader.

It is a feature of this invention that the loader bucket is provided with a mounting portion having a configuration corresponding to the curved back side of a backhoe bucket to facilitate a snug mounting therebetween.

It is an advantage of this invention that a backhoe machine can be utilized as a front end loader.

It is another object of this invention to provide a convenient means for easily installing a loader bucket to a narrower earthworking tool such as a backhoe bucket.

It is another feature of invention that the mounting apparatus of the loader bucket is provided with a pair of transversely spaced mounting flanges having connection means associated therewith to permit the attachment of the loader bucket to the sides of a backhoe bucket.

It is yet another feature of this invention that the mounting portion of the loader bucket can be recessed into the loader bucket cavity, as well as project rearwardly from the back wall of the loader bucket without diminishing the capacity of the loader bucket.

It is still another advantage of this invention that the hydraulic controls for manipulating the movement of the backhoe bucket relative to the articulated boom to which it is attached may be utilized to control the operation of the loader bucket mounted to the back side of the backhoe bucket.

It is a further object of this invention to provide a loader bucket for attachment to a narrower earthworking tool which is durable in construction, inexpensive of manufacture, carefree of maintenance, facile in assemblage and simple and effective in use.

These and other objects, features and advantages are accomplished according to the instant invention by providing a loader bucket wherein the rear wall portion of the loader bucket is provided with a mounting apparatus including opposing fore-and-aft extending mounting flanges having connection means associated therewith to permit the attachment of the loader bucket to the back side of a narrower backhoe bucket and, thereby, permit the backhoe to be utilized as a loader. The mounting apparatus is preferably recessed into the bucket cavity and is provided with a configuration corresponding to the curved back side of the backhoe bucket to permit a snug mounting therebetween.

BRIEF DESCRIPTION OF THE DRAWINGS

The advantages of this invention will become apparent upon consideration of the following detailed disclosure of the invention, especially when taken in conjunction with the accompanying drawings wherein:

FIG. 5 is a partial cross-sectional view taken along lines 5—5 of FIG. 1 to better show the scraper assembly, the tilting movement of the scraper blade and the transverse movement of the scraper blade relative to the support arm being respectively shown in phantom;

FIG. 6 is a cross-sectional detail view taken along lines 6—6 of FIG. 5 to show the mounting of the scraper blade to the support arm, the alternate positioning of the stabilizer pad being shown in phantom;

FIG. 7 is a cross-sectional detail view taken along lines 7—7 of FIG. 5 to better show the mounting of the scraper blade to the support arm;

DETAILED DESCRIPTION OF THE PREFERRED EMBODIMENT

Figure 1:
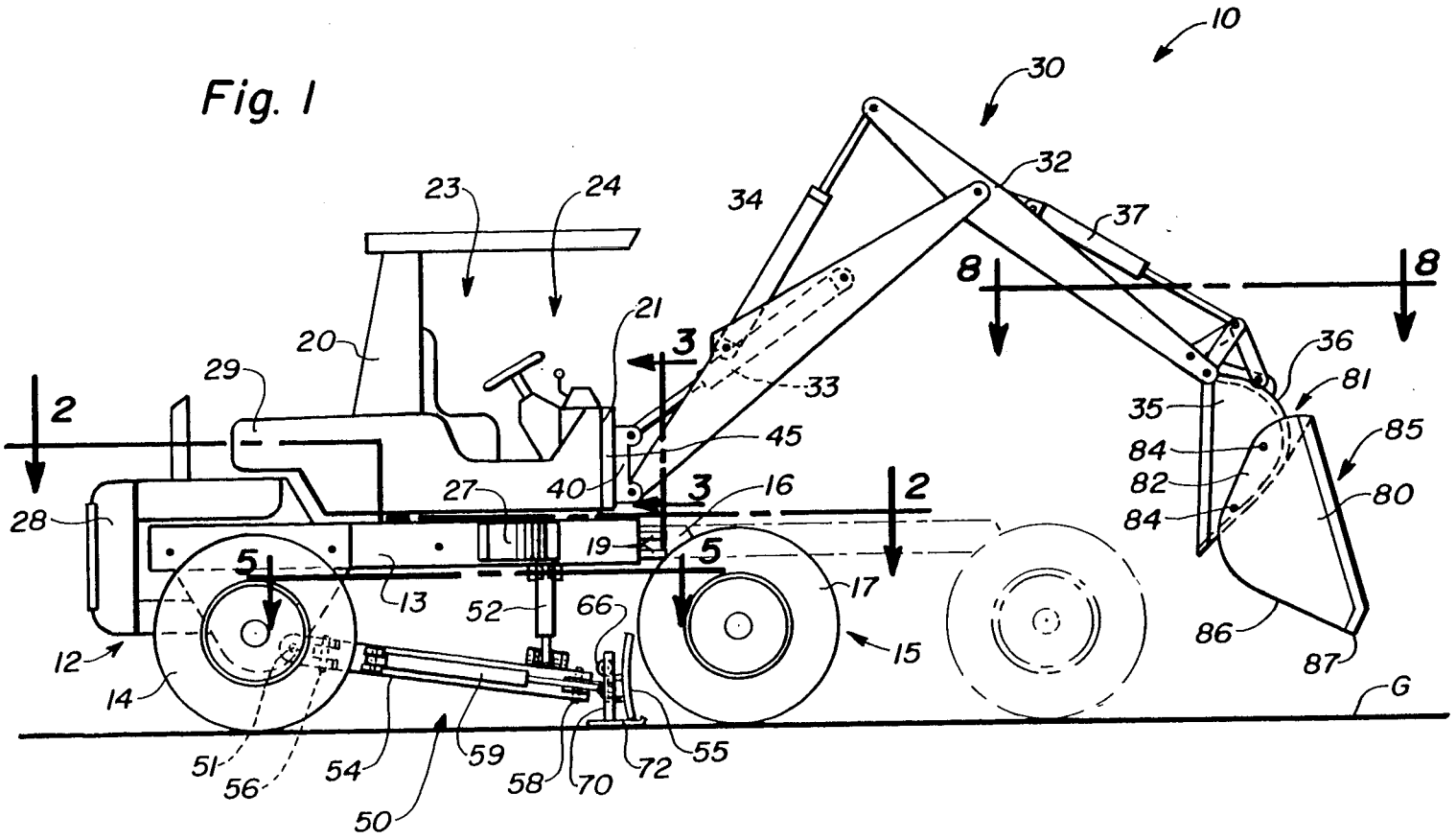
FIG. 1 is a side elevational view of an earthworking machine incorporating the principles of the instant invention, the telescopic movement of the front wheel assembly being shown in phantom.
Figure 2:
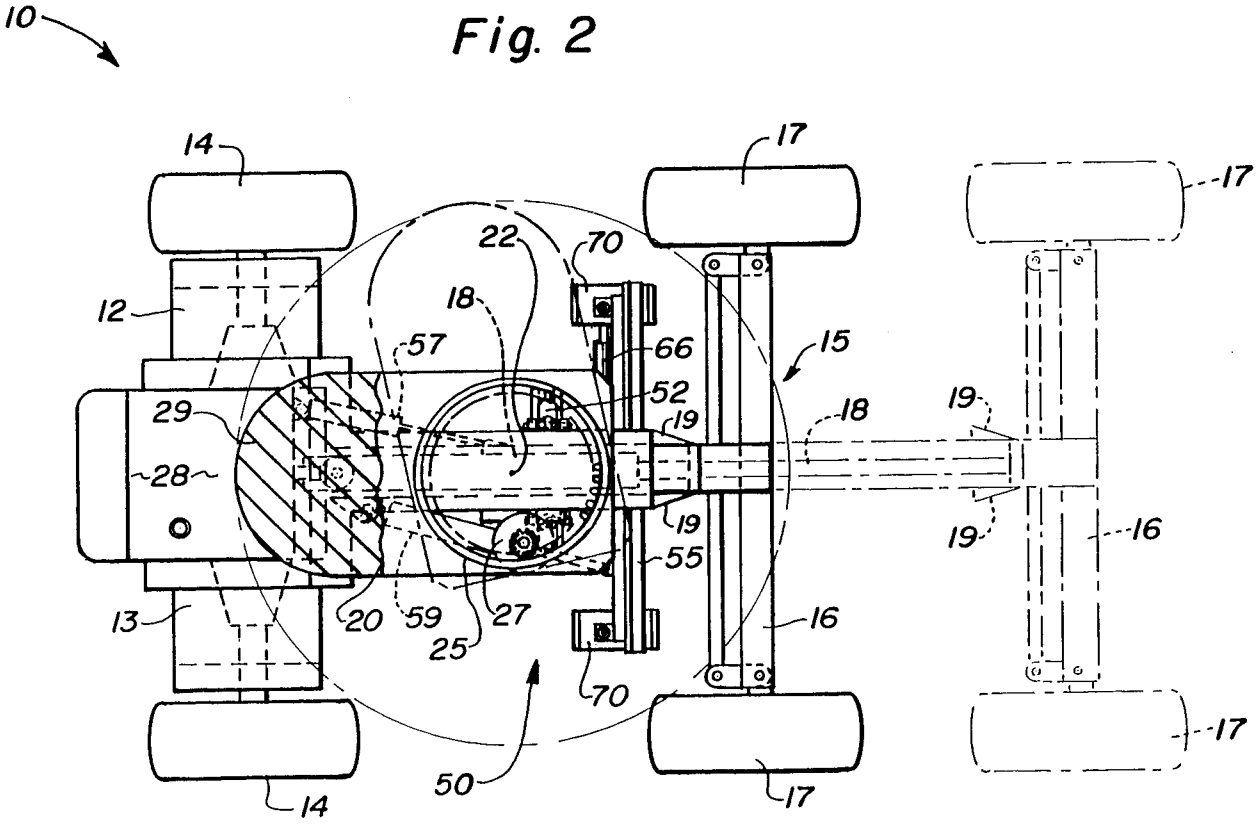
FIG. 2 is a cross-sectional view of the earthworking machine taken along lines 2—2 of FIG. 1, the rotational movement of the carriage being shown in phantom as well as the telescopic movement of the front wheel assembly.

Referring now to the drawings and, more particularly, to FIGS. 1 and 2, a front elevational view and a cross-sectional view of the multi-purpose earthworking machine incorporating the principles of the instant invention can best be seen. The earthworking machine 10 is provided with a mobile frame 12 which includes a rear subframe 13 rotatably mounting a pair of rear ground engaging wheels 14 and a front wheel assembly 15 which is provided with a pair of steerable front ground engaging wheels 17. The front wheel assembly 15 includes a front subframe 16 telescopically received within the rear subframe 13 and movable in a fore-and-aft direction by means of a hydraulic cylinder 18 positioned internally of the subframes 13,16 to affect the telescopic movement therebetween. Although the drawings depict a single telescopically related subframe member positioned along the centerline of the machine 10, it should be realized that a pair of transversely spaced telescopically related subframe members could be alternatively provided. Limits to the telescopic movement of the front subframe 16 can be hydraulically provided in conjunction with the hydraulic cylinder 18 or mechanically such as by an internal ring or the wing tabs 19.

The frame 12 has a carriage 20 rotatably mounted thereon for rotation about a generally vertical axis or rotation 22. The carriage 20 supports an operator's station 23 with controls, generally indicated with the reference numeral 24, to affect operation of the machine 10. The carriage 20 is provided with a ring gear 25 rotatably supported by the frame 12 and engageable with a motor 27, preferably hydraulically driven, to affect rotation of the ring gear 25 and attached carriage 20. The axis of rotation 22 corresponds to the center of said ring gear 25 forming the means of rotation of the carriage 20. It will be appreciated by one skilled in the art that a carriage 20 mounted in the manner described above is capable of rotation through an entire 360° arc; however, from a practical consideration, an arc of 270° centered about a fore-and-aft extending orientation would be sufficient for most operational purposes. An engine 28 can be mounted on the frame 12 rearwardly of the carriage 20 to provide operational power for the earthworking machine 10 and can be situated to permit effective movement of the carriage 20 about the vertical axis 22 with a rearward counterweight 29 being positioned to clear the engine 28 during its rotative movement.

A backhoe assembly 30 is mounted on the front face 21 of the carriage 20 and includes an articulated boom 32 hydraulically controlled in a conventional manner by hydraulic cylinders 33,34, and an earthworking tool shown in the form of a backhoe bucket 35 movably mounted on the end of the boom 32 and controlled in a conventional manner by means of a hydraulic cylinder 37. The backhoe assembly 30 is operable from the front face 21 of the carriage 20 throughout the entire range of rotation of the carriage 20 about the generally vertical axis 22 so as to be operable beyond the frame 12 to engage the ground G. Since the operator's station 23 rotates with the carriage 20, the operator will always have the digging operation of the backhoe assembly 30 occurring immediately in front of him with the controls 24 being easily accessible throughout the entire range of movement of the carriage 20, even when the backhoe assembly 30 is working laterally of the frame 12.

Figure 3:
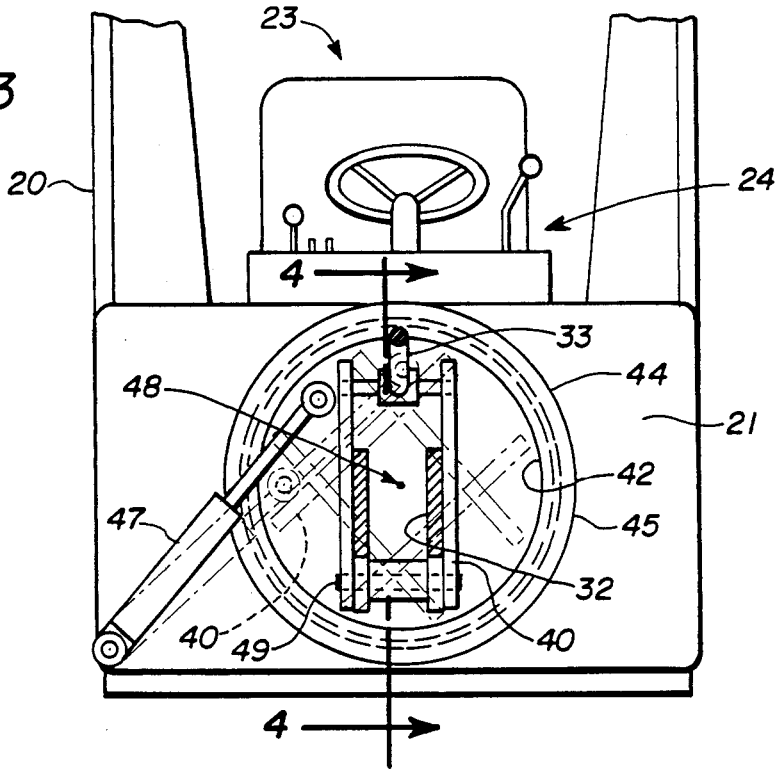
FIG. 3 is a partial cross-sectional view of the earthworking machine taken along lines 3—3 of FIG. 1 to show the thrust ring connecting the backhoe assembly to the front face of the carriage, the rotational movement of the mounting frame of the backhoe assembly being shown in phantom.
Figure 4:
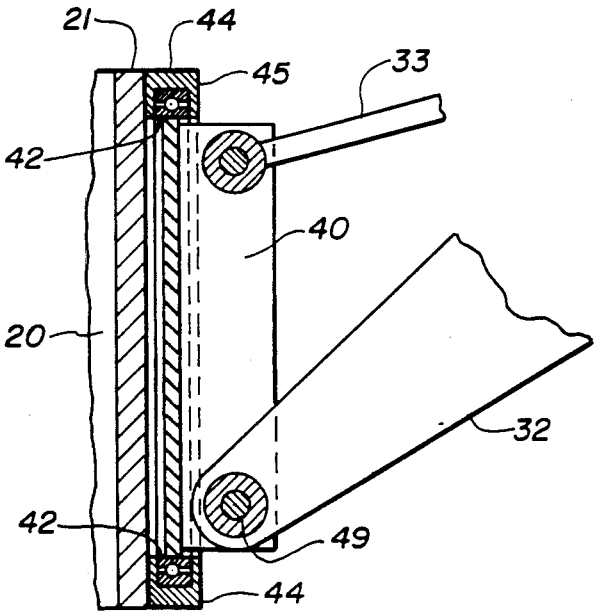
FIG. 4 is a partial cross-sectional view taken along lines 4—4 of FIG. 3 to show greater detail of the mounting of the backhoe assembly to the front face of the carriage.

Referring now to FIGS. 1, 3 and 4, the structure for mounting the backhoe assembly 30 to the front face 21 of the carriage 20 can best be seen. The backhoe assembly 30 includes a mounting frame 40 to which the articulated boom 32 and the hydraulic cylinder 33 are pivotally connected, the vertical movement of the boom 32 being controlled by the selectively variable length of the hydraulic cylinder 33 in a conventional manner. The mounting frame 40 is affixed to the inner race 42 of a thrust ring 45, the outer race 44 of the thrust ring 45 being affixed to the front face 21 of the carriage 20. The rotative movement of the mounting frame 40 and consequently the inner race 42 of the thrust ring 45 is controlled by a hydraulic cylinder 47 interconnecting the front face 21 of the carriage 20 and the mounting frame 40. As best seen in FIG. 3, the extension and contraction of the hydraulic cylinder 47 can affect a rotation of the mounting frame 40 through an arc of approximately 90° centered about a configuration in which the hydraulic cylinder 33 is positioned vertically above the pivot axis 49 of the articulated boom 32 carried by the mounting frame 40, which corresponds to the vertical orientation of the boom 32. This particular configuration described above permits the entire backhoe assembly 30 to be canted or tilted about a horizontal axis 48 extending outwardly from the front face 21 of the carriage 20, the horizontal axis 48 corresponding to the center of the thrust ring 45, thereby permitting the entire backhoe assembly 30 to be moved in the "Z plane". The normally horizontal pivot axis 49 of the boom 32 rotates with the mounting frame 40 about the horizontal axis of rotation 48, permitting the articulated boom 32 a full range of movement toward and away from the carriage 20 during its entire range of movement about the horizontal axis of rotation 48.

As can be seen in FIGS. 1, 2 and 5–7, the earthworking machine 10 is also provided with a scraper assembly 50 pivotally attached to the rear subframe 13 to permit a vertical movement thereof which can be affected by hydraulic cylinders 52. The scraper assembly 50 is provided with a forwardly extending support arm 54 upon which is mounted a scraper blade 55. The support arm 54 is articulated and is selectively movable about a first horizontally extending pivot 51 carried by the rear subframe 13 to permit the vertical movement of the scraper assembly 50 by the hydraulic cylinders 52, about a first generally vertical pivot 56 to permit a side-to-side swinging of the support arm 54 and attached blade 55 controlled by the hydraulic cylinder 57 interconnecting the rear subframe 13 and the support arm 54, about a second generally vertical pivot 58 to permit an angular movement of the scraper blade 55 relative to the support arm 54 as affected by the hydraulic cylinder 59 interconnecting the support arm 54 and a hat-shaped section 62 mounting the scraper blade 55 to the support arm 54.

The hat-shaped section 62 is pivotally connected to the support arm 54 by the pivot 58 and is engaged by the scraper blade 55 by means of a corresponding C-shaped channel into which the hat-shaped section 62 is slidably received. A hydraulic cylinder 66 interconnecting the hat-shaped section 62 and the C-shaped channel 64 selectively permits the blade 85 to be transversely shifted with respect to the support arm 54. Accordingly, it can be seen that the scraper assembly 50 can be positioned in virtually any configuration between the front and rear wheels 17,14 to affect the desired grading operation, with the support arm 54 being configured to push the scraper blade 55 across the ground G rather than pulling the blade across the ground as is typical with prior art graders.

Referring again to FIGS. 1, 2, and 5–7, the scraper assembly 50 is also provided with a pair of transversely spaced stabilizer pads 70 mounted adjacent opposing ends of the scraper blade 55. Each stabilizer pad 70 includes a ground engaging member 72 which is selectively positionable beneath the scraper blade 55 to serve as stabilizing outriggers when the earthworking machine 10 is being utilized as a backhoe or loader as will be described in greater detail below. Each stabilizer pad 70 is shown as having a support shaft 74 extending upwardly from the ground engaging member 72 and being received through a sleeve 76 supported by the hat-shaped member 62. A pin 77 extending through the sleeve 76 and through a corresponding hole in the support shaft 74 locks the stabilizer pad 70 into its preselected position. To facilitate proper engagement between the ground engaging member 72 and the scraper blade 55, due to the capability of the blade 55 to be moved transversely with respect to the hat-shaped member 62, each sleeve 76 is positionably connected to the hat-shaped member 62 to permit a selective corresponding movement of the sleeve 76 in a transverse direction relative thereto.

When the machine 10 is being utilized as a grader and, consequently the stabilizer pads 70 need to be moved into a non-ground engaging position, the support shaft 74 can be reinserted through the top of the sleeve and pinned into position by the pin 77 such that the ground engaging member 72 rests on top of the scraper blade 55 as shown in phantom in FIGS. 6 and 7. Alternatively, the stabilizer pad 70 could be swivelly mounted to the hat-shaped section 62 to permit the ground engaging member 72 to be pivoted into respective ground engaging and non-ground engaging positions relative to the scraper blade 55. The use of the blade 55 to rest upon the ground engaging member 72 when used as a stabilizing outrigger permits the hydraulic cylinders 52 to exert downward pressure thereon to fully affect a stabilizing of the machine 10 when it is being utilized as a backhoe.

Figure 9:
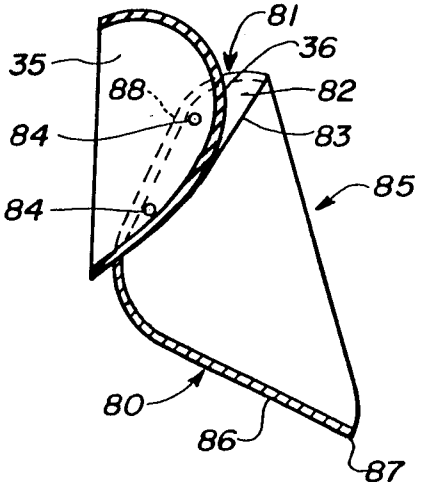
FIG. 9 is a partial cross-sectional detail view taken along lines 9—9 of FIG. 8 to show the mounting of the loader bucket to the backhoe bucket.
Figure 8:
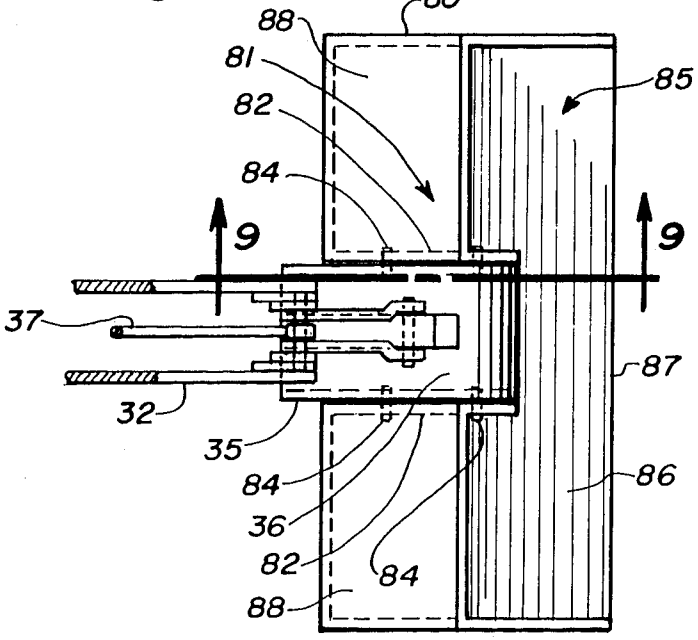
FIG. 8 is a partial cross-sectional view taken along lines 8—8 of FIG. 1 to show the mounting of the loader bucket to the backhoe bucket forming a part of the backhoe assembly.

Referring now to FIGS. 1, 8 and 9, it can be seen that the backhoe bucket can be equipped with a loader bucket 80 having a floor portion 86 equipped with a material engaging edge 87 to permit the machine 10 to be utilized as a loader, as well as a backhoe and grader. The back wall 88 of the loader bucket 80 is provided with a mounting apparatus 81 including fore-and-aft extending mounting flanges 82 transversely spaced a distance substantially equal to the width of the backhoe bucket 35. A transverse wall 83 extending between the fore-and-aft extending sidewalls 82 is of a configuration to conform to the shape of the back side 36 of the backhoe bucket 35. As a result, the loader bucket 80 can be positioned snugly against the back side 36 of the backhoe bucket 35 and fixed into position by a pair of connecters 84, which can be in the form of mounting pins, interengaging corresponding holes in the fore-and-aft extending mounting flanges 82 and the sides of the backhoe bucket 35. The mounting apparatus 81 could be literally recessed into the cavity 85 of the loader bucket 80, whereby the back side 36 of the backhoe bucket 35 could form the transverse wall 83 without the need to have a separate transverse wall 83, or, alternatively, could project rearwardly from the back wall of the loader bucket 80 so that the capacity of the bucket cavity 85 would not be diminished. The hydraulic cylinder 37 controlling the motion of the backhoe bucket 35 relative to the articulated boom 32 will also control the attitude of the loader bucket 80 since it is connected directed to the backhoe bucket 35.

It will be understood by one skilled in the art that an earthworking machine 10 configured as described above will be operable to function as a backhoe, loader, grader and also as a dozer when utilized with a dozer blade equipped similarly to the loader bucket 80 described above. The telescopible front wheel assembly 15 can be positioned rearwardly toward the rear wheels 14 when the machine 10 is utilized as a backhoe or loader so as to give the earthworking tools 35,80 sufficient room to operate both forwardly and laterally of the machine 10 by virtue of the rotatable carriage 20 upon which the backhoe assembly 30 is rotatably mounted. When the machine 10 is utilized as a grader, the front wheel assembly 15 can be extended forwardly away from the rear wheels 14 through actuation of the hydraulic cylinder 18 to permit a greater control of the scraper assembly 50 as is desirable with such machines. The canting of the backhoe assembly 30 about the horizontal axis 48 permits the backhoe 80 to be utilized in situations heretofore unrealized without limiting the range of motion of the earthworking tool 35,80.

It will be understood that various changes in the details, materials, steps and arrangements of parts which have been described and illustrated to explain the nature of the invention, will occur to and may be made by those skilled in the art upon a reading of the disclosure within the principles and scope of the invention. The foregoing description illustrates preferred embodiments of the invention. However, concepts, as based upon such a description, may be employed in other embodiments without departing from the scope of the invention. Accordingly, the following claims are intended to protect the invention broadly, as well as in the specific form shown herein.

Having thus described the invention, what is claimed is:

1. In a loader bucket for utilization with a backhoe having an articulated boom with a backhoe bucket connected at a remote end thereof such that said backhoe has a first bucket cavity normally open toward said backhoe, said loader bucket having a second bucket cavity defined by an integral floor portion, a pair of opposing, transversely spaced side wall portions and a rear wall portion, said floor portion having a transverse material engaging edge spaced forwardly of said rear wall portion and extending between said side wall portions, the transverse spacing of said side wall portions defining the width of said loader bucket, the improvement comprising:

a mounting apparatus recessed from said rear wall portion into said bucket cavity and including a pair of opposing, fore-and-aft extending mounting flanges, each said mounting flange having a pair of holes therein; and connectors interchangeable between the holes in said mounting flanges and corresponding holes in opposing sides of said backhoe bucket having a width substantially smaller than the width of said loader bucket to permit the attachment of said loader bucket to a back side of said backhoe bucket such that said second bucket cavity is open away from said backhoe to permit a loading operation therewith upon an extension of said articulated boom.

2. The loader bucket of claim 1 wherein said mounting flanges are transversely spaced a distance substantially equal to the width of said backhoe bucket, said mounting flanges being spaced substantially equidistantly from the corresponding said side wall portion.

3. The loader bucket of claim 2 wherein said mounting apparatus also includes a transverse wall member extending between said mounting flanges, said transverse wall member having a shape corresponding to said back side of said backhoe bucket, whereby said loader bucket is attachable against said back side of said backhoe bucket in engagement with said transverse wall member.

4. The loader bucket of claim 2 wherein said rear wall portion includes an opening therein between said mounting flanges, said back side of said backhoe bucket closing said opening when mounted to said loader bucket.

5. In a backhoe having an extensible, articulated boom having a backhoe bucket mounted at a distal end thereof, said backhoe bucket having a rear side and a pair of integrally connected spaced apart side walls defining the width of said backhoe bucket and a first bucket cavity with an open side normally facing said backhoe, said backhoe bucket being operable by contraction of said articulated boom to dig toward said backhoe, the improvement comprising:

a loader bucket having a second bucket cavity defined by an integral floor portion, a pair of opposing, transversely spaced side wall portions and a rear wall portion, the transverse spacing of said side wall portions defining the width of said loader bucket, said loader bucket including a mounting apparatus recessed from said rear wall portion into said bucket cavity, said mounting apparatus including a pair of opposing, fore-and-aft extending mounting flanges spaced transversely a distance substantially equal to the width of said backhoe bucket, each said mounting flange having a pair of holes therein;

said backhoe bucket having a width less than the width of said loader bucket, said side walls of said backhoe bucket having a pair of holes formed therein to register with the pair of holes in each of said mounting flanges; and connectors interchangeable between the holes in said mounting flanges and the holes in the side walls of said backhoe bucket to detachably connect said loader bucket to the rear side of said backhoe bucket so that said second bucket cavity opens away from said backhoe, permitting an extensible movement of said articulated boom to effect a loading of said loader bucket.

6. The backhoe of claim 5 wherein said mounting apparatus also includes a transverse wall member extending between said mounting flanges, said transverse wall member having a shape corresponding to said back side of said backhoe bucket, whereby said loader bucket is attachable against said back side of said backhoe bucket in engagement with said transverse wall member.

7. The backhoe of claim 5 wherein said rear wall portion of said loader bucket includes an opening therein between said mounting flanges, said back side of said backhoe bucket closing said opening when mounted to said loader bucket.

* * * * *